US006515941B1

(12) United States Patent
Suzuki et al.

(10) Patent No.: US 6,515,941 B1
(45) Date of Patent: Feb. 4, 2003

(54) ELECTRONIC WATCH

(75) Inventors: Kenji Suzuki, Chiba (JP); Akihiro Iino, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/512,238

(22) Filed: Feb. 24, 2000

(51) Int. Cl.[7] ..... G04B 19/24

(52) U.S. Cl. ..... 368/28; 368/160; 368/157; 368/30; 310/323.17

(58) Field of Search ..... 368/157, 160, 368/187, 28, 37, 15, 223, 228; 310/323, 328, 368, 366, 323.17, 323.16

(56) References Cited

U.S. PATENT DOCUMENTS 5,091,670 A * 2/1992 Kawata et al. ..... 310/323
5,095,469 A * 3/1992 Leuenberger et al. ..... 368/187
5,274,614 A * 12/1993 Yamazaki ..... 368/28
5,357,489 A * 10/1994 Luthier ..... 368/37
5,566,140 A * 10/1996 Kohata et al. ..... 368/187
5,852,336 A * 12/1998 Takagi ..... 310/323
5,960,380 A * 9/1999 Flentov et al. ..... 368/10
6,066,911 A * 5/2000 Lindermann et al. ..... 310/328
6,088,300 A * 7/2000 Nakajima et al. ..... 368/28
6,088,302 A * 7/2000 Nakajima et al. ..... 368/37
6,218,769 B1 * 4/2001 Iino et al. ..... 310/328
6,266,296 B1 * 7/2001 Miyazawa ..... 368/28
6,310,834 B1 * 10/2001 Nosaka ..... 368/157

* cited by examiner

*Primary Examiner*—Vit Miska
*Assistant Examiner*—Jeanne-Marguerite Goodwin
(74) *Attorney, Agent, or Firm*—Adams & Wilks

(57) ABSTRACT

An electronic watch which can be small-sized even with an additional mechanism such as a calendar mechanism. In the electronic watch, a rectangular piezoelectric oscillator 32 acting as a piezoelectric actuator is forced at its end face to contact with a beam portion 35, which is mounted on a date ring 31 acting as a second indication member, thereby to drive the date ring 31 directly.

30 Claims, 17 Drawing Sheets

ELECTRONIC WATCH

BACKGROUND OF THE INVENTION

1. Field of the Invention

The present invention relates to an electronic watch and, more particularly, to an electronic watch which can be small-sized even with a calendar indicating function.

2. Related Art

FIG. 17 is a top plan view showing one example of the electronic watch of the prior art. This electronic watch 900 having an auto-calendar function, which is provided in addition to a time indicating stepping motor 901 with a stepping motor 902 for a calendar indicating mechanism so that it can be freed from the trouble of correcting the date at the end of a month by driving the calendar portion independently of the time indicating portion. The stepping motor 902 is composed of a coil 921, a stator 922 and a rotor 923, which is provided with a reduction gear mechanism 904 for transmitting a rotating torque to a date ring 903. The rotor 923 is equipped with a pinion 924 for transmitting a rotating torque to the reduction gear mechanism (or a reduction gear train). This reduction gear mechanism 904 is composed of a first intermediate date ring 941 and a second intermediate date gear 942.

The calendar indication mechanism is composed of the date ring 903 having an inner circumference toothed at 932, and a date gear 931 engaging with the second intermediate date gear 942 for transmitting the rotating torque to the date ring 903. This date ring 903 is rotatably arranged on the (not-shown) calendar back plate.

The stepping motor 902 is electrically connected with a circuit block attached to the back of a base plate 905, so that it is rotated with drive pulses coming from an electronic circuit. The rotations of the stepping motor 902 are transmitted to the date gear 931 through the pinion 924 of the rotor 923, the first intermediate date ring 941 and the second intermediate date ring 942.

The date gear 931 engages with the teeth 932 so that the date ring 903 is rotated by the rotations of the date gear 931.

Since the torque to be generated by the stepping motor 902 is seriously low, however, the multistage reduction gear mechanism 904 is necessary for rotating the date ring 903. This has raised a problem that it is difficult to reduce the size of the electronic watch 900 which has multiple functions to indicate a variety of data in addition to the time information such as the auto calendar function.

Since the stepping motor 902 belongs to an electromagnetic conversion mechanism, on the other hand, it may exert an influence on the time indicating stepping motor 901. This makes it necessary to retain a distance between the two stepping motors 901 and 902. This necessity has made it impossible to reduce the size of the multi-function electronic watch 900.

SUMMARY OF THE INVENTION

Thus, the invention has been conceived in view of the foregoing description and has an object to provide an electronic watch which can be small-sized even with an additional function such as the calendar mechanism.

In order to achieve the above-specified object, according to the invention, there is provided an electronic watch wherein a piezoelectric actuator to be displaced by applying a voltage thereto is arranged in the vicinity of a portion of a second indication member for indicating data other than the time and is brought into press contact with the second indication member to drive the same directly.

When an alternating voltage or a pulsating voltage is applied to the piezoelectric element composing the piezoelectric actuator, the piezoelectric element is elongated and contracted by the piezoelectric effect so that a displacement corresponding to the applied voltage is established in the piezoelectric actuator. With the construction in which the piezoelectric actuator is brought into press contact with the second indication member, the displacement of the piezoelectric actuator causes a driving force of the second indication member through a friction. As the second indication member, there can be enumerated a date ring for indicating the date information, a chronograph and a moon face, for example. The piezoelectric actuator generates a higher force per unit volume than that of the stepping motor so that it can be made smaller in volume than the stepping motor and can be confined in the vicinity of a portion of the second indication member. Moreover, the high force makes the reduction gear mechanism unnecessary so that the electronic watch can be small-sized. Without the electromagnetic conversion mechanism, on the other hand, the piezoelectric actuator is not adversely affected by the time indicating stepping motor. Since the piezoelectric actuator need not be arranged apart from the time indicating stepping motor, therefore, it is possible to obtain an effect that the degree of freedom for designing the electronic watch is drastically enhanced. Here, similar operations and effects can be achieved in the invention, as will be described in the following.

According to the invention, on the other hand, there is provided an electronic watch wherein a second indication member for indicating data other than the time is disposed to confront a base plate, and wherein a piezoelectric actuator for establishing a displacement when a voltage is applied thereto is arranged between the base plate and the second indication member and is brought into press contact with the second indication member to drive the same directly.

The piezoelectric actuator is arranged between the second indication member such as the date ring and the base plate and is directly driven with the laminated structure in which it is is brought into press contact with the second indication member. As a result, the planar space can be drastically reduced while eliminating the reduction gear train, so that the multi-function electronic watch can be remarkably small-sized.

According to the invention, on the other hand, there is provided an electronic watch wherein a second indication member for indicating data other than the time is disposed to confront a base plate, wherein the second indication member is provided with a beam portion on its face confronting the base plate, and wherein a piezoelectric actuator for establishing a displacement by applying an electric signal to a piezoelectric element is brought into press contact with the side face of the beam portion thereby to drive the second indication member directly.

The construction is made such that the second indication member such as the date ring is provided with the beam portion on its face confronting the base plate and such that the piezoelectric actuator is brought into press contact with the side face of the beam portion. As a result, the mechanism for forcing the piezoelectric actuator to contact with the side face of the beam portion can be planarly arranged so that the electronic watch can be small-sized and thinned. With this construction, on the other hand, the contacting state of the piezoelectric actuator and the second indication member can be stabilized to provide another effect that the drive of the second indication member can be excellently stabilized. The method of applying the piezoelectric actuator to the beam portion maybe exemplified by urging the piezoelectric actuator directly or by pushing the piezoelectric actuator from the face opposed to the contacting face. Another effect is that a high degree of freedom for the design can be achieved to reduce the size of the electronic watch effectively.

On the other hand, an electronic watch according to the invention is characterized in that the piezoelectric actuator is a rectangular piezoelectric oscillator including: a first rectangular piezoelectric element having on its surface four divided electrodes, two individuals of which are electrically shorted to construct two sets of electrode groups; and a second rectangular piezoelectric element having an electrode extending substantially all over the surface, and in that the rectangular piezoelectric oscillator is caused to generate bending oscillations and longitudinal oscillations harmonically by applying a predetermined alternating voltage to the individual electrodes of the rectangular piezoelectric element.

The rectangular piezoelectric oscillator is used as the piezoelectric actuator so that the second indication member such as the date ring is directly driven in the frictional manner by the oscillatory waves. By using the resonant phenomenon between the bending oscillations and the longitudinal oscillations, the elliptical motions are obtained in the surface of the rectangular oscillator so that a slippage between the forced contacting faces of the piezoelectric actuator and the second indication member is reduced to provide a high efficiency.

As set forth in the inventions above, on the other hand, an electronic watch according to the invention is characterized in that the piezoelectric actuator is a piezoelectric oscillator including: a first rectangular piezoelectric element having on its surface four electrodes which are equally divided in a cross shape and two orthogonal ones of which are electrically shorted to construct two sets of electrode groups; and a second rectangular piezoelectric element having an electrode extending substantially all over the surface, and in that the rectangular piezoelectric oscillator is caused to generate bending oscillations and longitudinal oscillations harmonically by applying a predetermined alternating voltage to the individual electrodes of the rectangular piezoelectric element.

In the rectangular piezoelectric oscillator to be used as the piezoelectric actuator, there is used the first rectangular piezoelectric element having on its surface the four electrodes which are equally divided in the cross shape and the two orthogonal ones of which are electrically shorted to construct the two sets of electrode groups. According to this construction, the strong bending oscillations can be established, and a higher force can be generated in addition to the effect of the invention according to the inventions above. As a result, the piezoelectric actuator itself can be small-sized to reduce the size and thickness of the electronic watch having the multiple functions.

As set forth in the inventions above, on the other hand, an electronic watch according to the invention is characterized in that the piezoelectric actuator is a laminated piezoelectric oscillator prepared by laminating and sintering a plurality of rectangular piezoelectric elements including the first rectangular piezoelectric element and,the second rectangular piezoelectric element.

By using the laminated piezoelectric oscillator which is prepared by laminating and sintering the rectangular piezoelectric elements, the generated force of the piezoelectric actuator is increased according to the number of layers. A higher output can be made in a smaller size so that the piezoelectric actuator itself can be drastically small-sized to provide an advantage in the size reduction of the electronic watch.

As set forth in the inventions above, on the other hand, an electronic watch according to the invention is characterized in that the piezoelectric actuator includes a protrusion is brought into press contact with the second indication member to drive the same directly.

Since the second indication member is is brought into press contact with the protrusion formed on the piezoelectric a actuator, there is achieved an effect to extract only the displacement component which is effective for driving the second indication member directly by the friction from the displacement of the piezoelectric actuator. Thus, it is possible to realize the stable drive of the second indication member of a high performance.

As set forth in the inventions above, on the other hand, an electronic watch according to the invention is characterized by further comprising: a base plate prepared by combining a first base plate and a second base plate having a fitting portion, and in that the piezoelectric actuator and the second indication member are mounted on the second base plate.

The base plate is given the divided structure, and one base plate is provided with the piezoelectric actuator and the second indication member other than the time indication. When the electronic watch without the second indication member such as the date function is to be manufactured, therefore, it can be constructed exclusively of the first base plate without the second base plate having the date ring and the piezoelectric actuator for driving the date ring directly. On the contrary, the electronic watch having an additional function such as the date function of multiple functions can be manufactured not by changing the first base plate having the time indication portion but merely by fitting the second base plate for the date function in the first base plate. By thus using the second base plate having the second indication member and the piezoelectric actuator acting as the drive source for the former, the first base plate acting as the time indication portion common among the electronic watches can be shared among all the kinds of electronic watches so that various electronic watches of multiple functions can be provided at reasonable prices.

As set forth in the inventions above, on the other hand, an electronic watch according to the invention is characterized by further comprising: second indication member movement amount detecting means for detecting the movement of the second indication member; and a control circuit for controlling the piezoelectric actuator on the basis of a signal which is detected by the second indication member movement amount detecting means.

The amount of the movement of the second indication member is detected so that the control circuit controls the driven state of the piezoelectric actuator on the basis of that amount of the movement. In the case of the date ring in which the second indication member displays the date information, for example, it is detected by the second indication member movement amount detecting means whether or not the date ring is rotated for one day. The piezoelectric actuator is driven by the control circuit till the amount of the movement for one day is reached. When the predetermined amount of the movement is exceeded, a backward run is effected to stop the drive of the piezoelectric actuator at a predetermined position.

As set forth in the inventions above, on the other hand, an electronic watch according to the invention is characterized by further comprising: a rotary member engaging with and interlocked by the second indication member, and in that the second indication member movement amount detecting means detects the amount of the movement of the second indication member by detecting the rotating state of the rotary member.

The amount of the movement of the second indication member is detected by detecting the rotating state of the rotary member engaging with the second indication member. As a result, the rotation angle of the rotary member may be sufficient for detecting the amount of the movement of the second indication member more accurately so that the accurate control of the additional function can be made to provide an electronic watch of a high performance.

DESCRIPTION OF THE PREFERRED EMBODIMENTS

The invention will be described in detail with reference to the accompanying drawings. Here, the invention should not be restricted by its embodiments.

Figure 1:
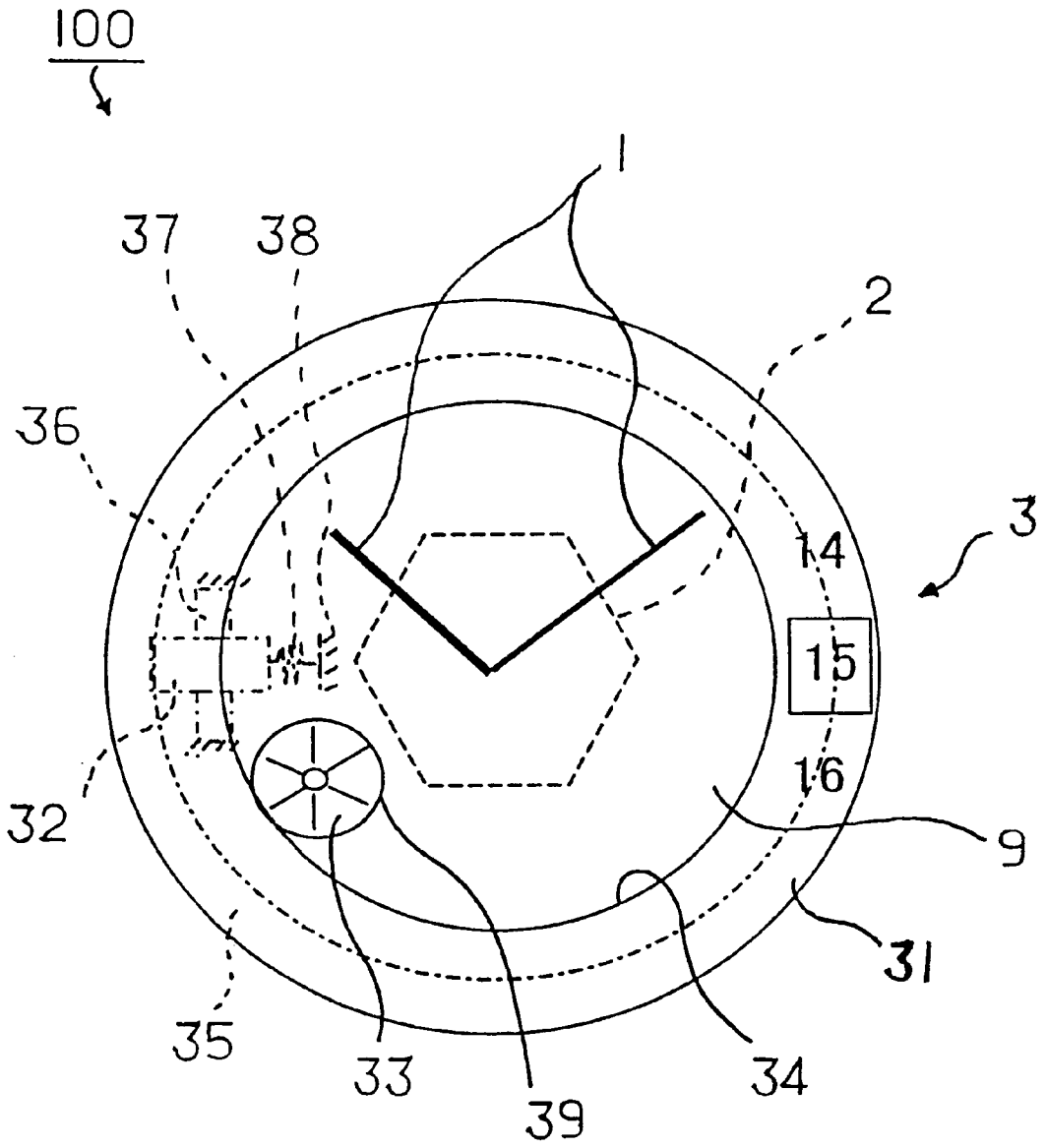
FIG. 1 is a construction diagram showing an electronic watch according to Embodiment 1 of the invention.
Figure 2:
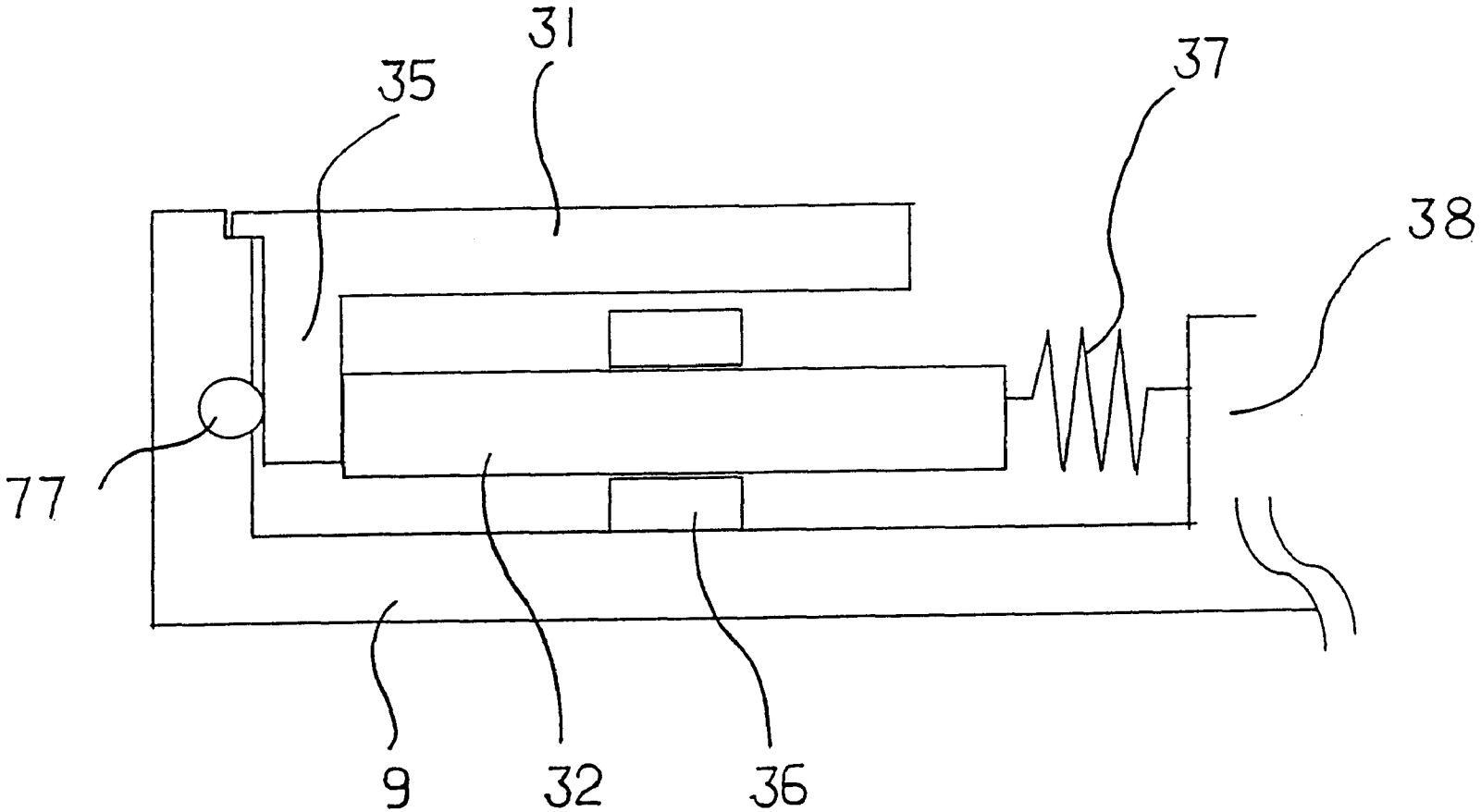
FIG. 2 is a sectional view of a portion of the electronic watch shown in FIG. 1.

FIG. 1 is a construction diagram showing an electronic watch according to Embodiment 1 of the invention. FIG. 2 is a sectional view of a portion of the electronic watch shown in FIG. 1. This electronic watch 100 is constructed to comprise: a first indication member 1 including an hour hand and a minute hand; a time indication mechanism 2 including a coil block, a gear train, a circuit block and a battery; and a calendar mechanism 3.

This calendar mechanism 3 is provided with a date ring 31 acting as a second indication member, a rectangular piezoelectric oscillator 32 acting as a piezoelectric actuator, and a rotation detector 33. The date ring 31 is printed with dates "1" to "31" on its surface and is provided with teeth 34 on its inner side. On the other hand, the date ring 31 is provided with a ring-shaped beam portion 35 on its lower face.

The rectangular piezoelectric oscillator 32 is arranged as a piezoelectric actuator in the vicinity of a portion of the circumferential edge of the date ring. On the other hand, the rectangular piezoelectric oscillator 32 is supported at its central portion by a support member 36 so as to slide in the longitudinal direction and is pressed at its leading end by a pressure spring 37 acting as an elastic member so as to contact with the inner face of the beam portion 35. Between the outer circumference of the beam portion 35 and a base plate 9, there is sandwiched a ball bearing 77. The other end of the pressure spring 37 is fixed by a lug 38 which is formed on the base plate 9.

The rotation detector 33 is composed of: a gear 39 acting as a rotary member engaging with and interlocked by the second indication member; and a rotation sensor 40 acting as second indication member movement amount detecting means.

The gear 39 acting as the rotary member engages with the teeth 34 of the date ring 31.

Figure 3:
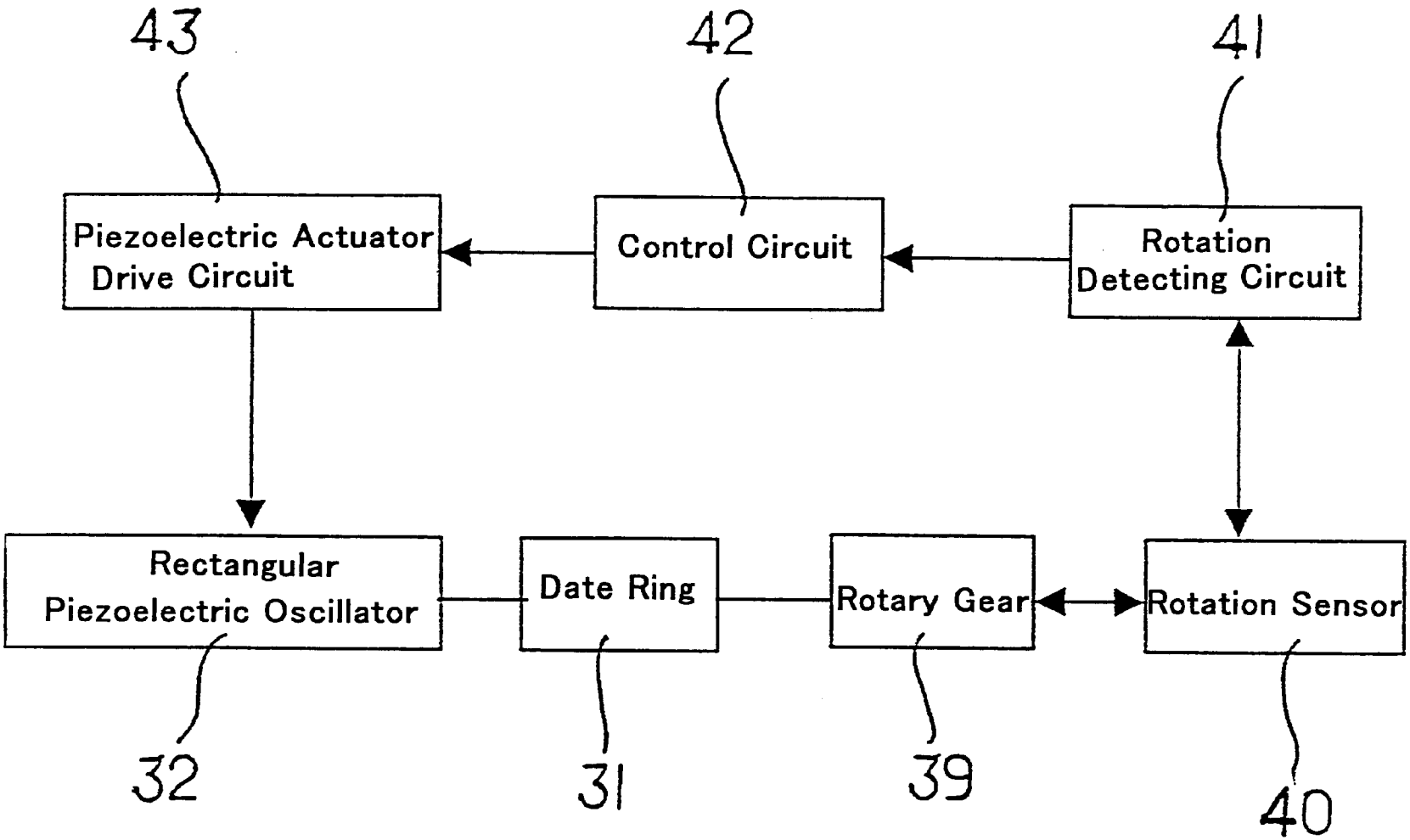
FIG. 3 is a block diagram showing a circuit construction of the electronic watch shown in FIG. 1.
Figure 4:
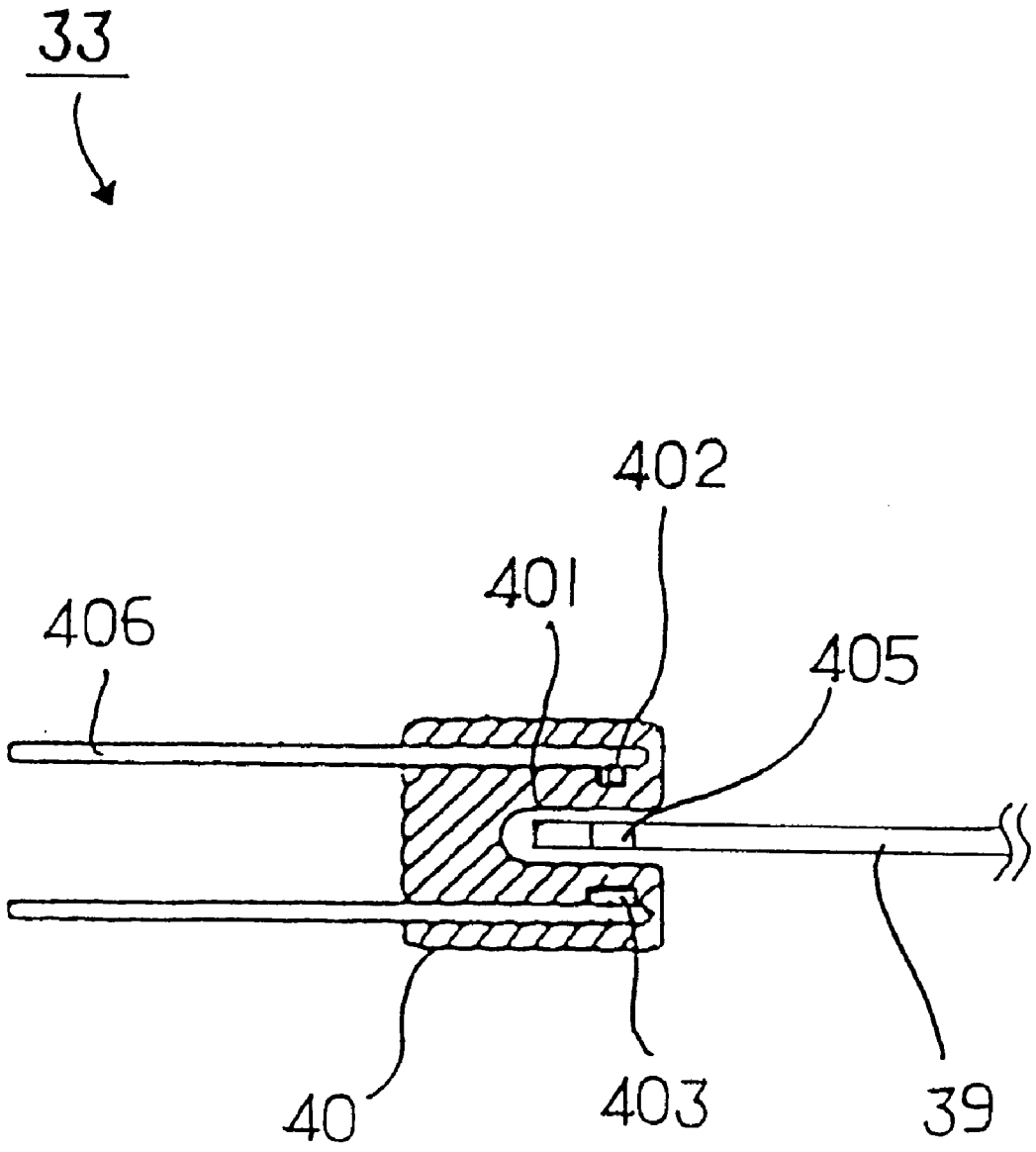
FIG. 4 is a sectional view of the construction of a rotation detector.

FIG. 3 is a block diagram showing a control system of the calendar mechanism 3 of this electronic watch. The rotation sensor 40 is connected with a rotation detecting circuit 41, which is disposed in the circuit block so that its output signal is fed to a control circuit 42. On the other hand, this control circuit 42 controls a piezoelectric actuator drive circuit 43. The rectangular piezoelectric oscillator 32 drives the date ring 31 and rotates the gear 39 in accordance with the rotation of the date ring 31. The circuit block is attached (although not shown) to the back of the base plate FIG. 4 is a sectional view of the construction of the rotation detector 33. The rotation sensor 40 is provided with a groove 401, in which an LED 402 and a phototransistor 403 are arranged on the opposed faces. The groove 401 of the rotation sensor 40 is arranged around the outer circumference of the gear 39 and is passed by a slit 405 formed in the outer circumference of the gear 39. Through this slit 405, the LED light is received by the phototransistor 403. In response to the light reception signal from the phototransistor 403, the rotation of the date ring 31 is detected. The rotation sensor 40 is connected at its terminals 406 with the rotation detecting circuit 41.

Figure 5:
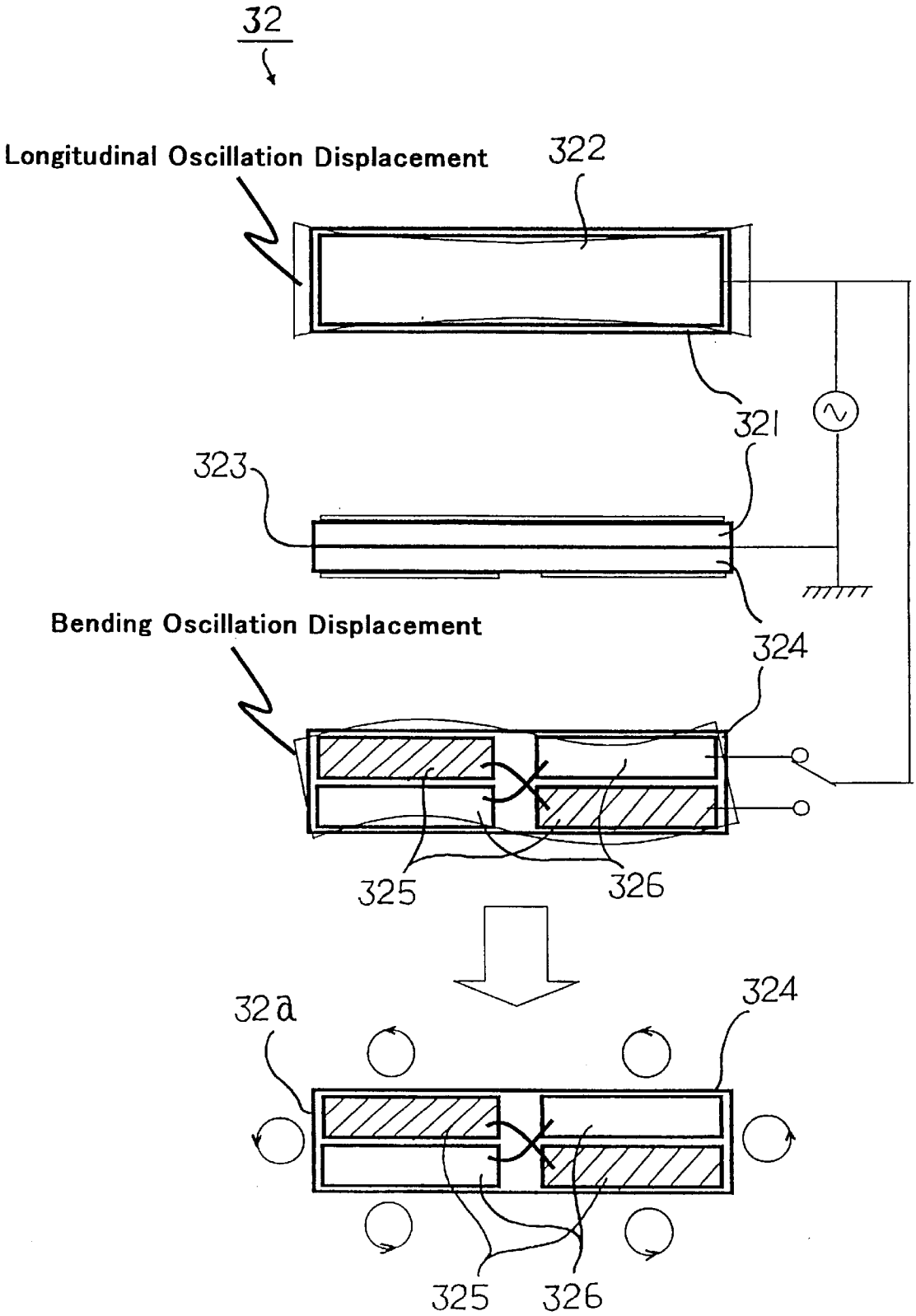
FIG. 5 is a construction diagram showing a piezoelectric actuator shown in FIG. 1.

FIG. 5 is a diagram showing the construction of the rectangular piezoelectric oscillator 32 or the piezoelectric actuator, as shown in FIG. 1. This rectangular piezoelectric oscillator 32 is a resonant type actuator composed of two piezoelectric elements. All over one face of a first-layer piezoelectric element 321, there is formed an electrode 322 (as shown in the top of FIG. 5). On a second-layer piezoelectric element 324, there are formed four electrodes which are divided substantially equally in a cross shape. Of these, the orthogonal electrodes are shorted to each other to construct two sets of electrode groups 325 and 326 (as shown in the third from the top of FIG. 5). On the faces of the two piezoelectric element 321 and 324 to be bonded, moreover, there is formed an electrode 323 (or a GND electrode) which is bonded by an adhesive (as shown in the next from the top of FIG. 5). On the other hand, these electrodes are formed by a vacuum deposition method in this embodiment, but a sputtering method or a printing method may be used.

The rectangular piezoelectric oscillator 32 is used as the actuator by applying an alternating voltage to the electrodes of the piezoelectric element to generate longitudinal oscillations and bending oscillations simultaneously. The rectangular piezoelectric oscillator 32 is determined so that the resonance frequency of the longitudinal oscillations and the resonance frequency of the bending oscillations may approach. When an alternating voltage of a frequency near the resonant point is applied, a phase difference is established in the displacements of the longitudinal oscillations and the bending oscillations on the basis of the discrepancy of the resonant points of the longitudinal oscillations and the bending oscillations so that displacements of elliptical loci are obtained (as shown in the bottom of FIG. 5) on the side face of the rectangular piezoelectric oscillator 32. With the rectangular piezoelectric oscillator 32 for generating such oscillations being is brought into press contact with the date ring 31 or the second indication member by a predetermined pressure.

The piezoelectric element 321 generates the longitudinal oscillations, and the piezoelectric element 324 generates the bending oscillations. Either of the two sets of electrode groups 325 and 326, as disposed in the piezoelectric element 324, is used, and the bending oscillations to be generated by the electrode group 325 and the bending oscillations to be generated by the electrode group 326 are inverted in the directions of their oscillatory displacements. By selecting one of two sets of electrode groups 325 and 326 of the piezoelectric element 324, more specifically, the displacement directions of the elliptical loci to be generated on the side face of the rectangular piezoelectric oscillator 32 are inverted. The rotating direction of the date ring 31 is determined by switching the electrode groups 325 and 326. Here, the piezoelectric actuator is exemplified by the rectangular piezoelectric oscillator but could be constructed of a disc-shaped piezoelectric oscillator, the type of which should not be restricted but could be exemplified by one using single oscillations.

Here will be described the operations of this electronic watch. The control circuit 42 outputs a date turning signal, when 24 hours elapsed, to the piezoelectric actuator drive circuit 43. As a result, a predetermined alternating voltage is applied to the piezoelectric elements 321 and 324 of the rectangular piezoelectric oscillator 32. When the alternating voltage is thus applied to the piezoelectric elements 321 and 324, the oscillations are caused by the piezoelectric effects of the piezoelectric elements 321 and 324. The oscillating state is shown in the bottom of FIG. 5, in which the side face of the rectangular piezoelectric oscillator 32 is caused to make the elliptical motions by the longitudinal oscillations of the piezoelectric element 321 and by the bending oscillations of the piezoelectric element 324. The rectangular piezoelectric oscillator 32 is forced at its end portion 32*a* to contact with the beam portion 35 by the pressure spring 37 so that the date ring 31 is rotated by the frictional force between the end portion 32*a* and the beam portion 35. To the memory of the electronic watch, on the other hand, there are inputted in advance calendar data, so that the control circuit 42 discriminates a month with thirty or less days and a 31-day month at the end of a month, to decide how many days the date ring is to be driven, thereby to output a signal to the piezoelectric actuator drive circuit 43.

When the date ring 31 turns, the rotation sensor 40 detects the turning state of the gear 39 engaging with the teeth 34 of that date ring 31 and outputs a signal to the rotation detecting circuit 41. This signal coming from the rotation detecting circuit 41 and indicating the rotational quantity is fed to the control circuit 42. This control circuit 42 discriminates the rotational quantity of the date ring 31 and feeds a stop signal to the piezoelectric actuator drive circuit 43 when the date ring 31 makes one turn. In response to this stop signal, the drive of the rectangular piezoelectric oscillator 32 is stopped to stop the rotation of the date ring 31. When it is decided that the date ring 31 has gone excessively far, the control circuit 42 outputs a backward command to the piezoelectric actuator drive circuit 43.

According to this electronic watch 100, as has been described hereinbefore, the rectangular piezoelectric oscillator 32 is used as the piezoelectric actuator to drive the date ring 31 directly. As a result, the reduction gear train is not required unlike the prior art, but the rectangular piezoelectric oscillator 32 or the piezoelectric actuator itself has a drastically small size so that the electronic watch can be small-sized and thinned without taking any large space. On the other hand, an electromagnetic conversion mechanism such as a stepping motor is not utilized to affect the stepping motor of the time indicating mechanism adversely. As a result, no consideration is taken into the arrangement relation between the rectangular piezoelectric oscillator 32 and the stepping motor so that the degree of freedom for, the design is enhanced.

Figure 6:
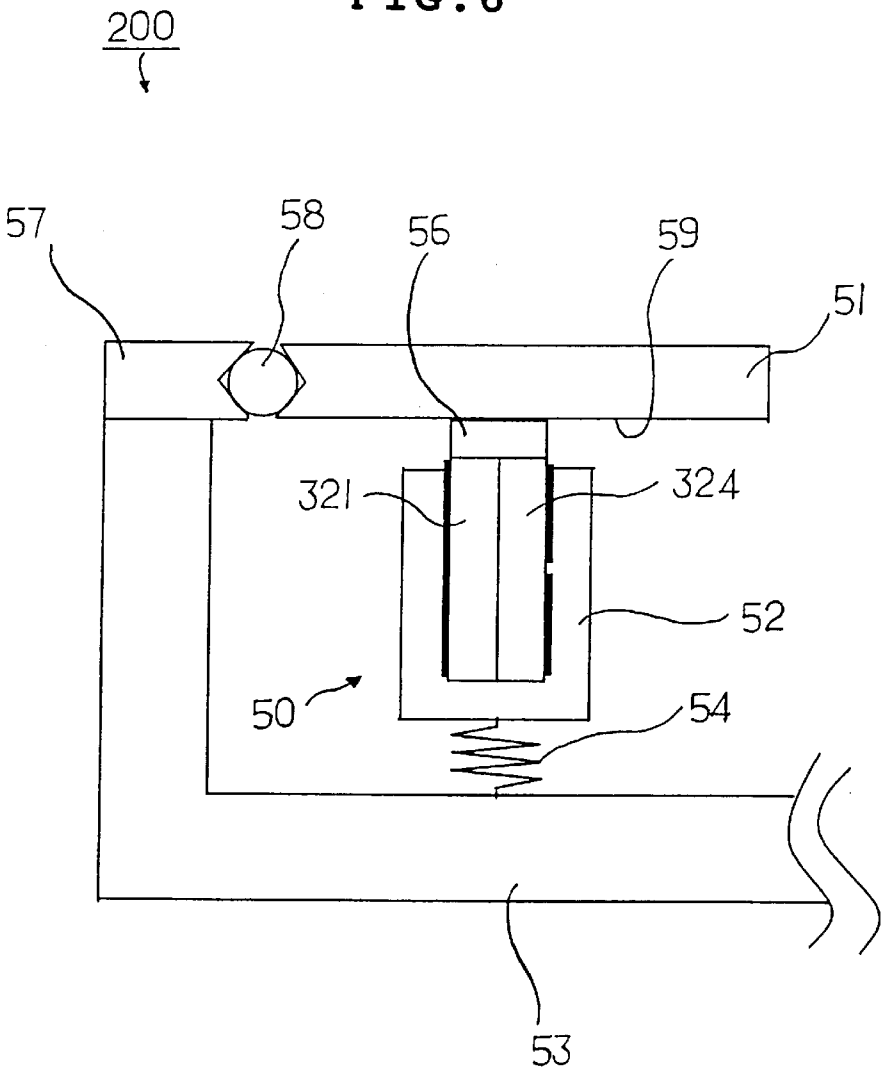
FIG. 6 is a sectional view showing a portion of an electronic watch according to Embodiment 2 of the invention.
Figure 7:
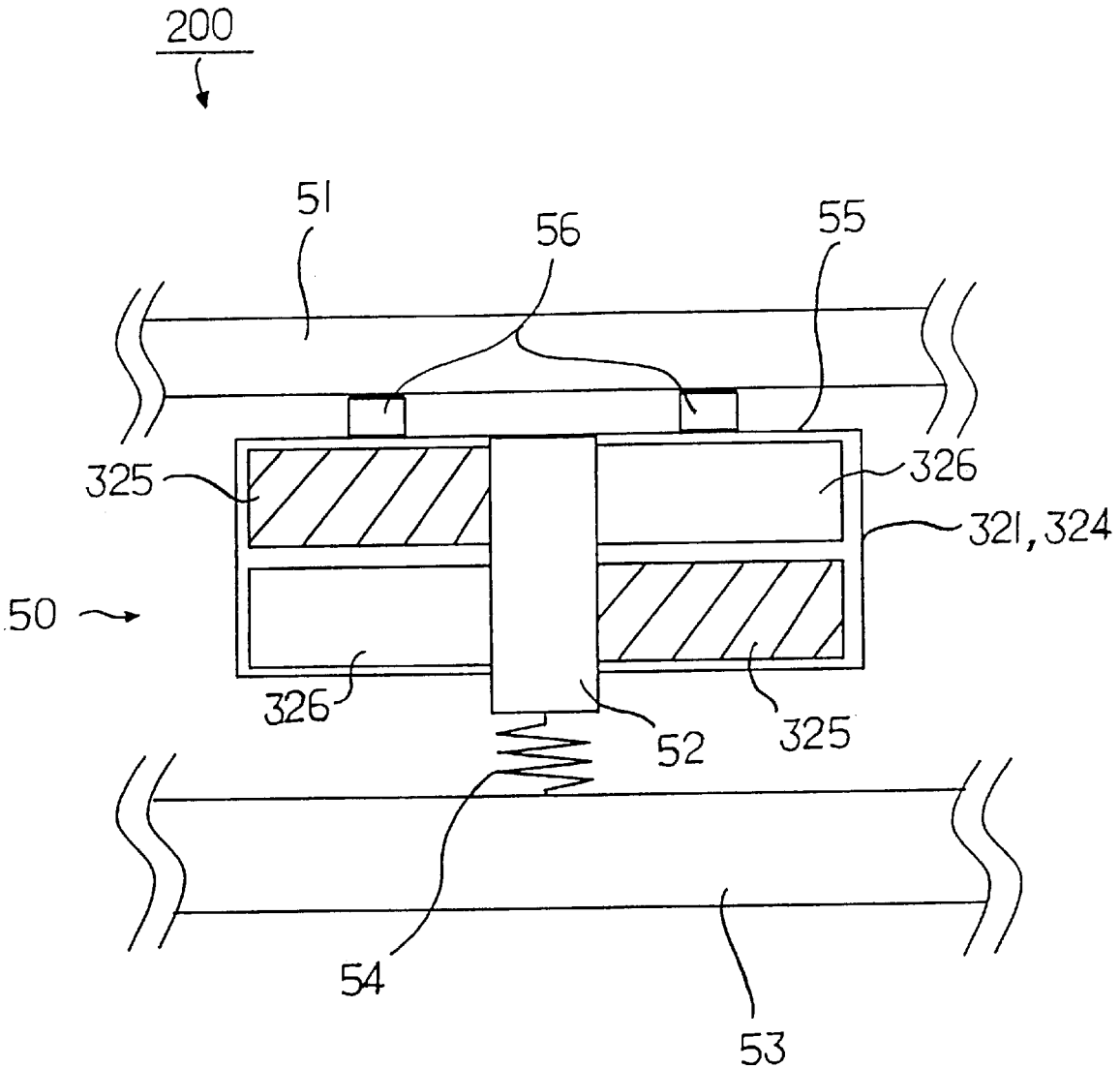
FIG. 7 is a side elevation of portion A of FIG. 6.

FIG. 6 is a sectional view showing a portion of an electronic watch according to Embodiment 2 of the invention. FIG. 7 is a side elevation of FIG. 6. A rectangular piezoelectric oscillator 50 is employed as the piezoelectric actuator. The construction of this rectangular piezoelectric oscillator 50 is basically similar to that of the rectangular oscillator 32 used in Embodiment 1 so that the description of its drive principle will be omitted (as should be referred to FIG. 5), but is characterized in that two protrusions 56 are provided for extracting the output from the side face in the longitudinal direction. In this electronic watch 200, there is taken a structure in which the rectangular piezoelectric oscillator 50 is arranged as the piezoelectric actuator below a date ring 51 acting as the second indication member so that the protrusions 56 are directly driven in the forced contact by the lower face of the date ring 51. In this structure, the rectangular piezoelectric oscillator 50 is clamped at its central portion by a bifurcated support member 52, and a pressure spring 54 is arranged between the support member 52 and a base plate 53. The output extracting protrusions 56, as provided on the rectangular piezoelectric oscillator 50, are exemplified by sliding members which are made of engineering plastics having a large coefficient of friction and an excellent wear resistance. On the other hand, it is desired that the protrusions 56 be homogeneously is brought into press contact with the date ring 51 and be retained to have a rigidity sufficient for transmitting the driving force efficiently. The protrusions 56 are integrated by adhering them to the piezoelectric elements 321 and 324. Here in this embodiment, the rectangular piezoelectric oscillator 50 or the piezoelectric actuator is provided with the protrusions 56 which are made of the engineering plastics having a large friction coefficient and an excellent wear resistance. In a modification, however, the protrusions 56 may be made of a general material such as a metal, and the date ring 51 may be prepared either by adhering a material having a large friction coefficient and an excellent wear resistance to its sliding face 59 on the protrusions 56 or by subjecting the sliding face 59 to a surface treatment such as a coating.

On the other hand, the date ring 51 is arranged on the inner circumference of a ring plate 57 which is disposed around the base plate 53, and a ball bearing 58 is sandwiched between the date ring 51 and the ring plate 57 to retain the date ring 51 rotatably. The remaining construction is similar to that of Embodiment 1 so that its description will be omitted.

When the predetermined alternating voltage is applied to either the electrodes 321 and 323 or the electrodes 325 and 326 of the piezoelectric elements 321 and 324, the protrusions 56, as mounted on the longitudinal side face 55 of the rectangular piezoelectric oscillator, 50, make the elliptical motions (as should be referred to FIG. 5). The protrusions 56 are in the forced contact with the contact face 59 of the date ring 51 so that the date ring 51 is directly driven by the elliptical motions of the protrusions 56 through the frictional force. The control system adopted for the date ring 51 is identical to that of Embodiment 1.

According to this electronic watch 200, the rectangular piezoelectric oscillator 50 or the piezoelectric actuator is arranged below the date ring 51 to drive the date ring 51 directly so that the planar space of the calendar mechanism of the electronic watch 200 can be reduced. On the other hand, the reduction gear train of the prior art can be dispensed with, and the size of the piezoelectric actuator itself is so smaller than that of the stepping motor that the electronic watch 200 can be small-sized.

Figure 8:
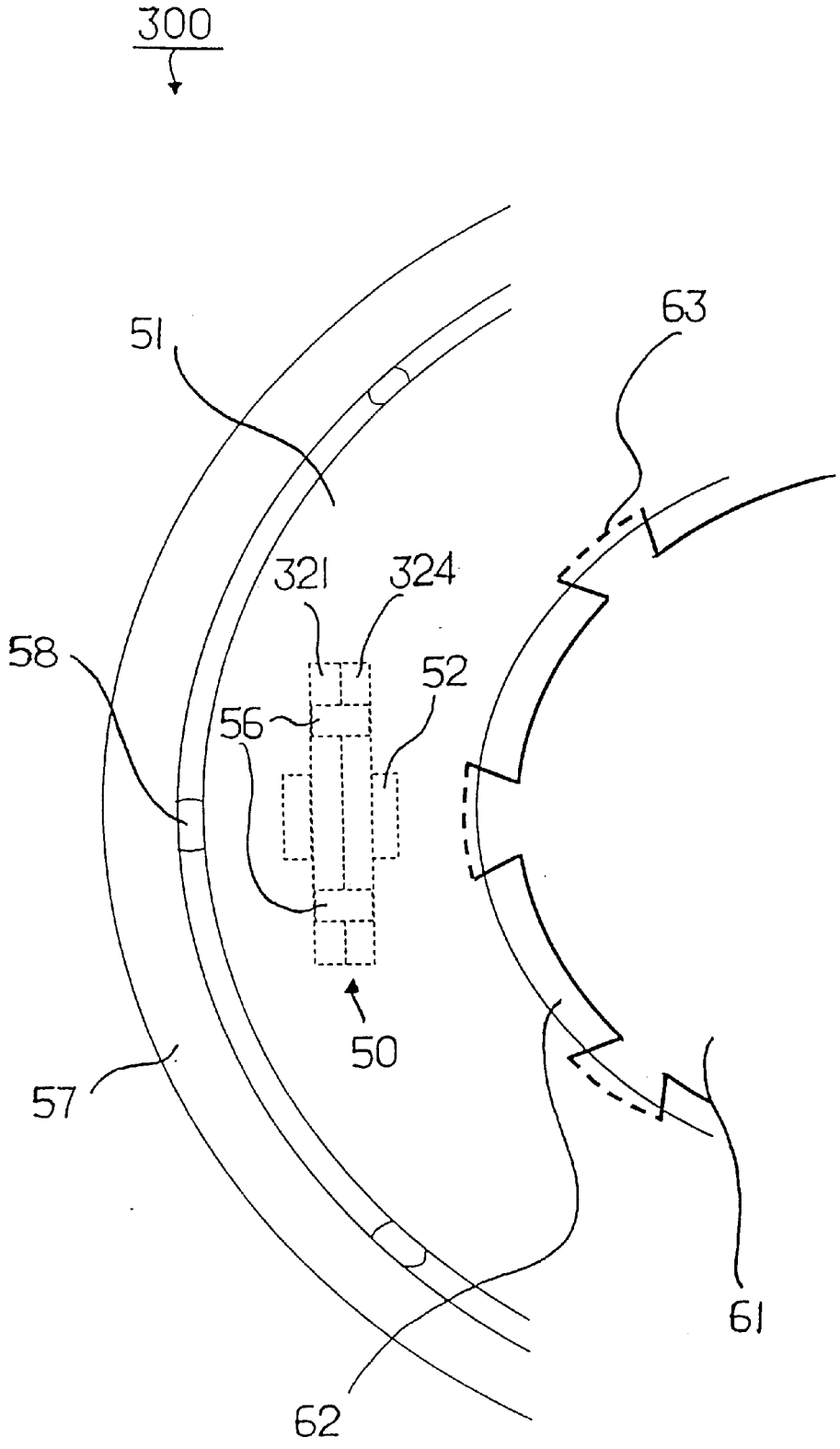
FIG. 8 is an explanatory top plan view showing a structure of an electronic watch according to Embodiment 3 of the invention.
Figure 9:
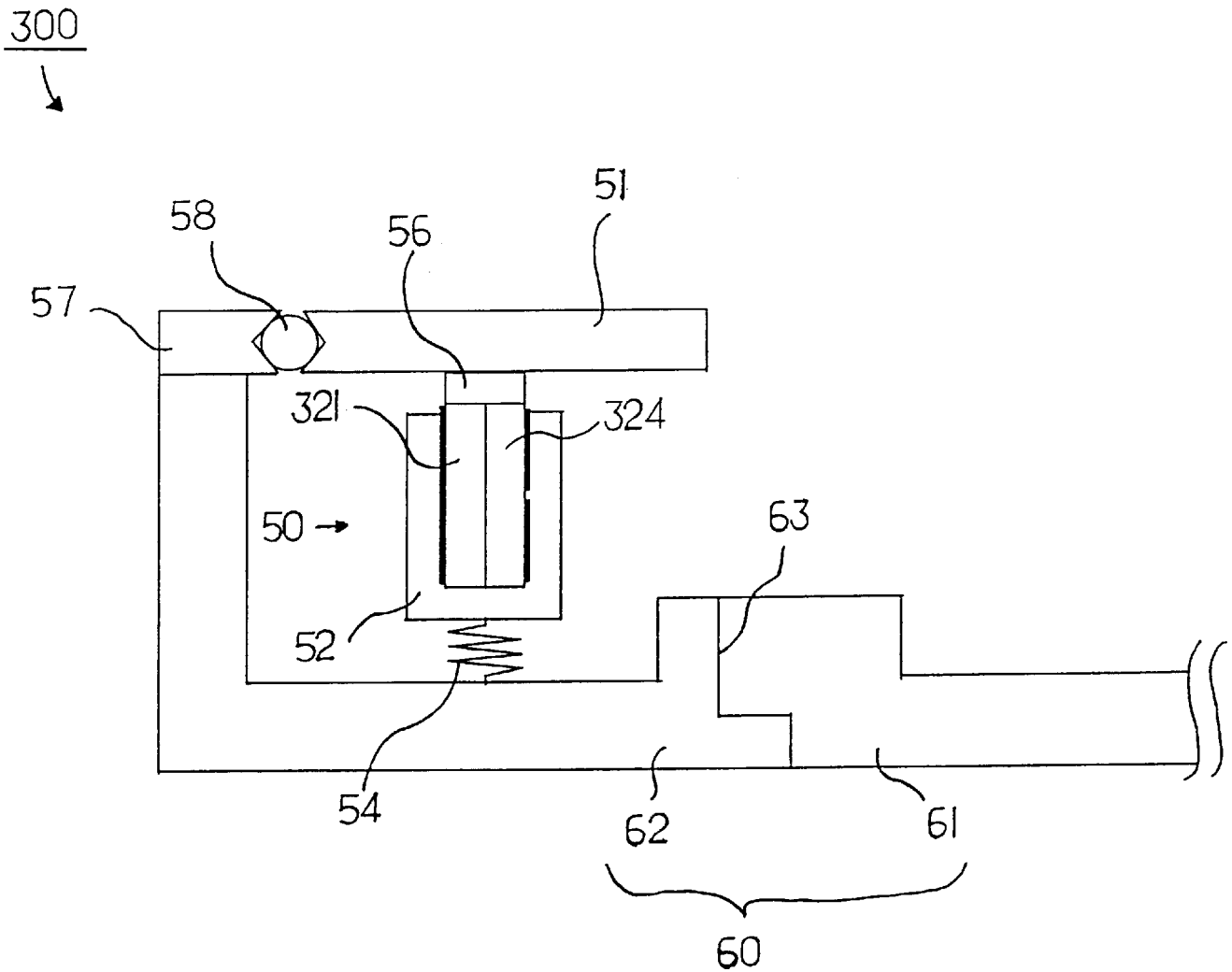
FIG. 9 is a sectional view of a portion of the electronic watch shown in FIG. 8.

FIG. 8 is, an explanatory top plan view showing a structure of an electronic watch according to Embodiment 3 of the invention. FIG. 9 is a sectional view of a portion of the electronic watch shown in FIG. 8. In this electronic watch 300, a base plate 60 is given a divisional structure, in which a first base plate 61 is provided for the time indication whereas a second base plate 62 is provided for the calendar indication. These first and second base plates 61 and 62 are provided with a fitting portion 63 of a dovetail type so that they can be integrated when vertically pushed. In the second base plate 62, there is arranged a piezoelectric actuator which is composed of the rectangular piezoelectric oscillator 50 and the support member 52 according to Embodiment 2. On the other hand, the date ring 51 is arranged on the inner circumference of the ring plate 57 mounted on the second base plate 62. The ball bearing 58 is sandwiched between the ring plate 57 and the date ring 51. The remaining construction is similar to that of Embodiment 2 so that its description will be omitted.

Some electronic watches are furnished with the calendar function, but others are not so that they require different base plates when manufactured. According to the construction described above, however, the second base plate 62 is added when the calendar function is necessary. As a result, the common part (i.e., the first base plate 61) can be shared between the electronic watches with and without the calendar function.

According to this electronic watch 300, the manufacture cost can be lowered because the electronic watches with and without the calendar function can share the common base plate. Here, the first base plate 61 and the second base plate 62 are assembled at the manufacturing step in the factory but could be assembled in the state of the final product.

Figure 10:
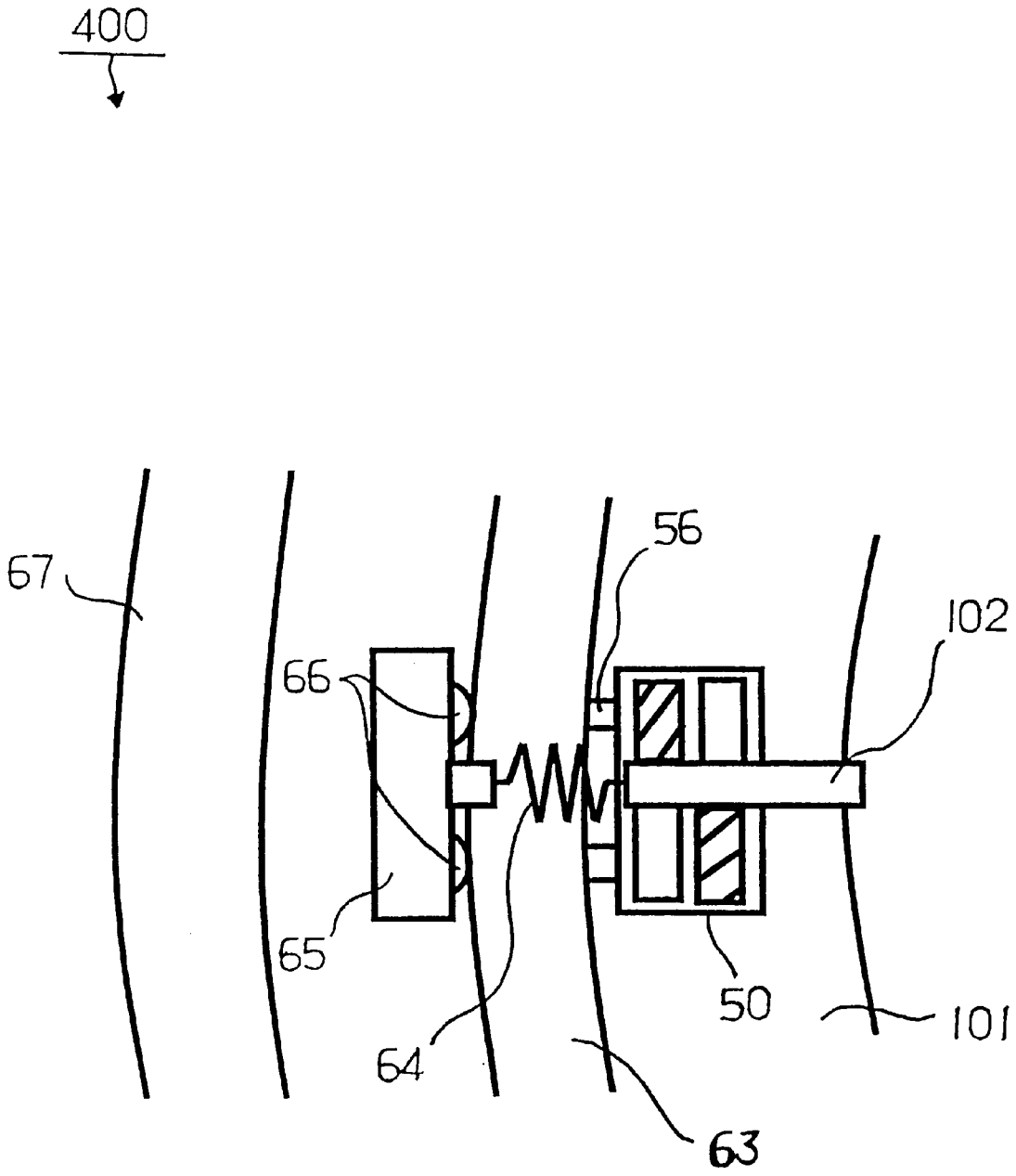
FIG. 10 is a top plan view showing a portion of the structure of an electronic watch according to Embodiment 4 of the invention.
Figure 11:
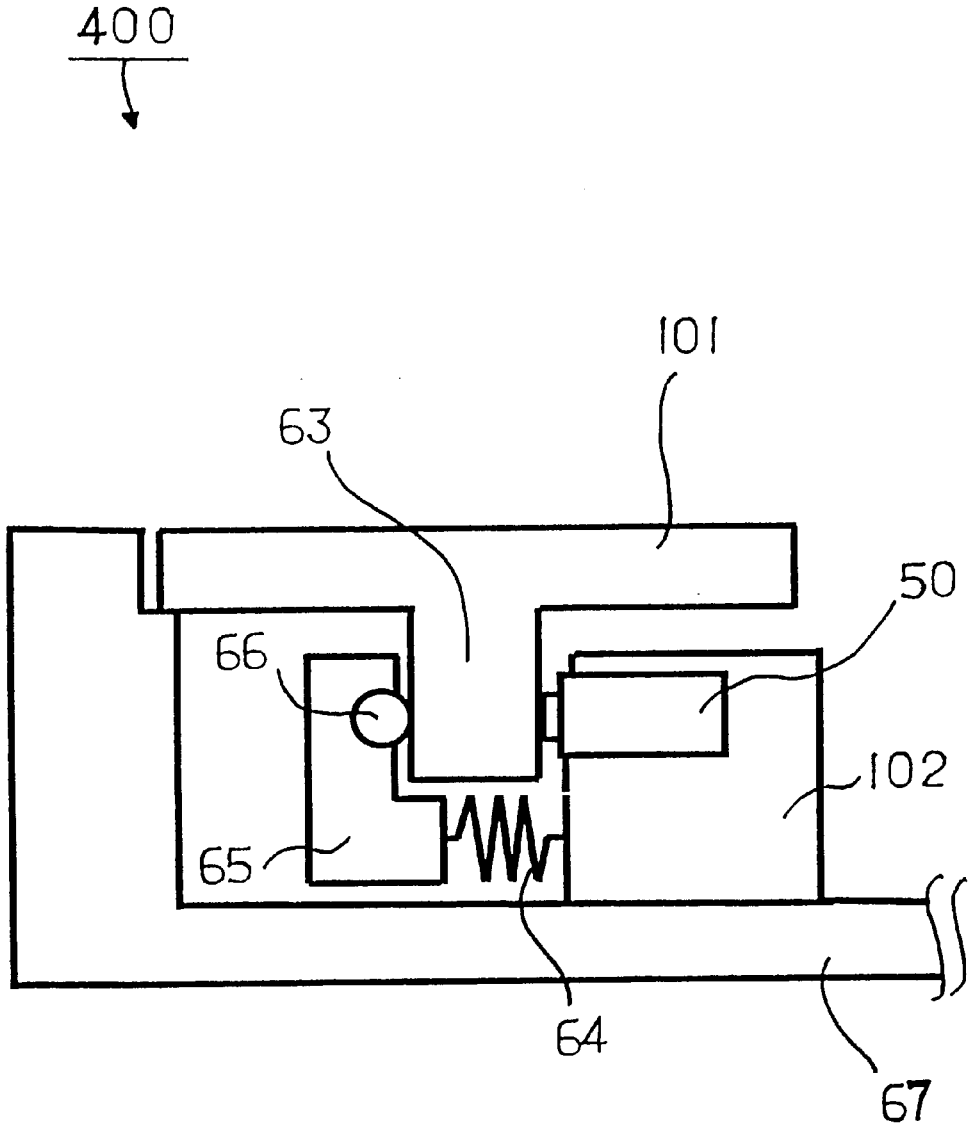
FIG. 11 is a sectional view of a portion of the electronic watch shown in FIG. 10.

FIG. 10 is a top plan view showing a portion of the structure of an electronic watch according to Embodiment 4 of the invention. FIG. 11 is a sectional view of a portion of the electronic watch shown in FIG. 10. The piezoelectric actuator in an electronic watch 400 according to Embodiment 4 uses the rectangular piezoelectric oscillator 50 of Embodiment 2 but is characterized by its supporting shape and its pressing method. The rectangular piezoelectric oscillator 50 is fixed at its central portion by a support member 102. A date ring 101 acting as the second indication member is provided with a beam portion 63 at its central portion on its face confronting the base plate. The output extracting protrusions 56, as disposed on the rectangular piezoelectric oscillator 50, are positioned on the inner face of the beam portion 63 of the date ring 101. On the other hand, the support member 102 is provided with a pressure spring 64, which is equipped with a pressure block 65 on its other end. Two rotatable ball bearings 66 are fitted in the pressure block 65.

When the pressure block 65 is pulled by the pressure spring 64, the ball bearings 66 come into abutment against the outer side of the beam portion 63. As a result, the date ring 101 is urged against the protrusions 56 of the rectangular piezoelectric oscillator 50. The date ring 101 is loosely fitted in a base plate 67 and is clamped between the pressure block 65 and the piezoelectric actuator 50. Even with this construction, the electronic watch 400 can be small-sized. Here, this construction could be modified to have the base plate of a divided structure, as in Embodiment 3.

Figure 12:
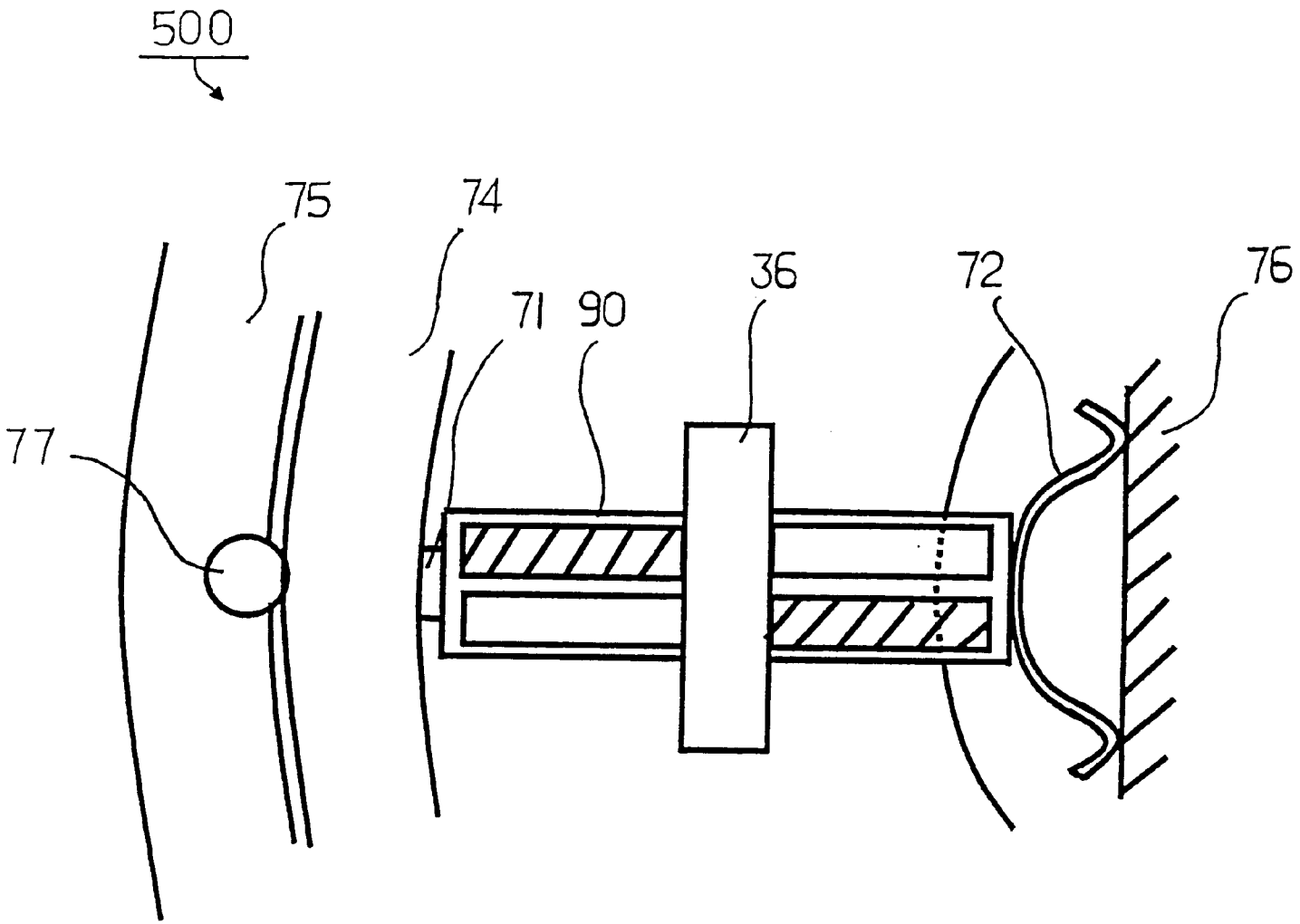
FIG. 12 is a top plan view showing a portion of an electronic watch according to Embodiment 5 of the invention.
Figure 13:
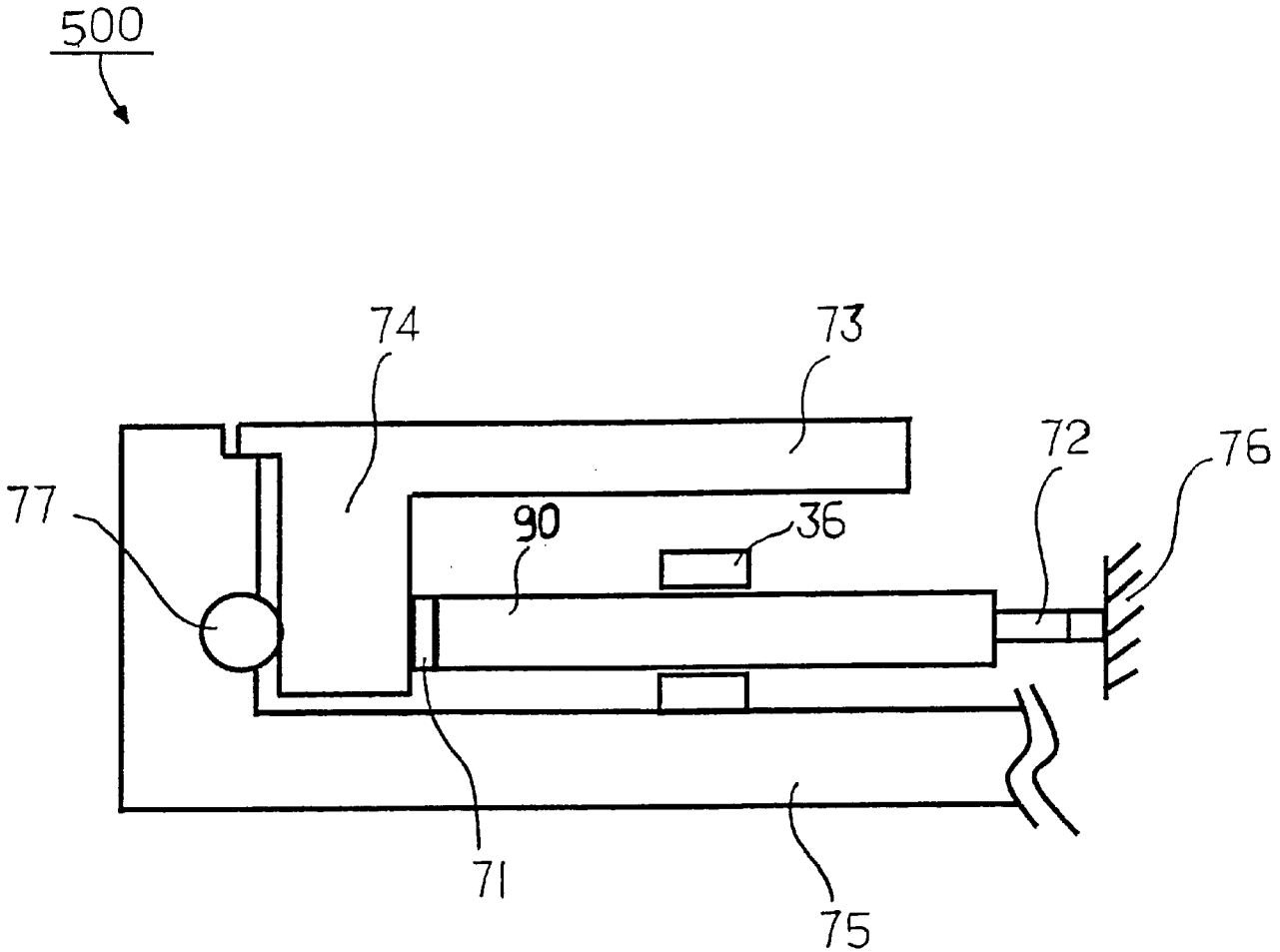
FIG. 13 is a sectional view of a portion of the electronic watch shown in FIG. 12.

FIG. 12 is a top plan view showing a portion of an electronic watch according to Embodiment 5 of the invention. FIG. 13 is a sectional view of a portion of the electronic watch shown in FIG. 12. This electronic watch 500 is given a construction substantially similar to that of the electronic watch 100 of Embodiment 1 but is different in that a rectangular piezoelectric oscillator 90 used as the piezoelectric actuator is provided on its shorter side with an output extracting protrusion 71. On the shorter side opposed to that having the protrusion 71, there is mounted a pressure spring 72, by which the protrusion 71 is pushed onto a beam portion 74 of a date ring 73. The pressure spring 72 is supported on a lug 76 which is formed on a base plate 75.

This pressure spring 72 is made of a curved leaf spring. A central portion of the rectangular piezoelectric oscillator 90 is supported by the support member 36 so that it can slide in the longitudinal direction.

The ball bearing 77 is sandwiched between the outer circumference of the beam portion 74 and the base plate 75.

The remaining construction and the operations of this electronic watch 500 are similar to those of Embodiment 1 so that their description will be omitted. Here in this construction, the base plate can be given the divided structure as in Embodiment 3.

Figure 14:
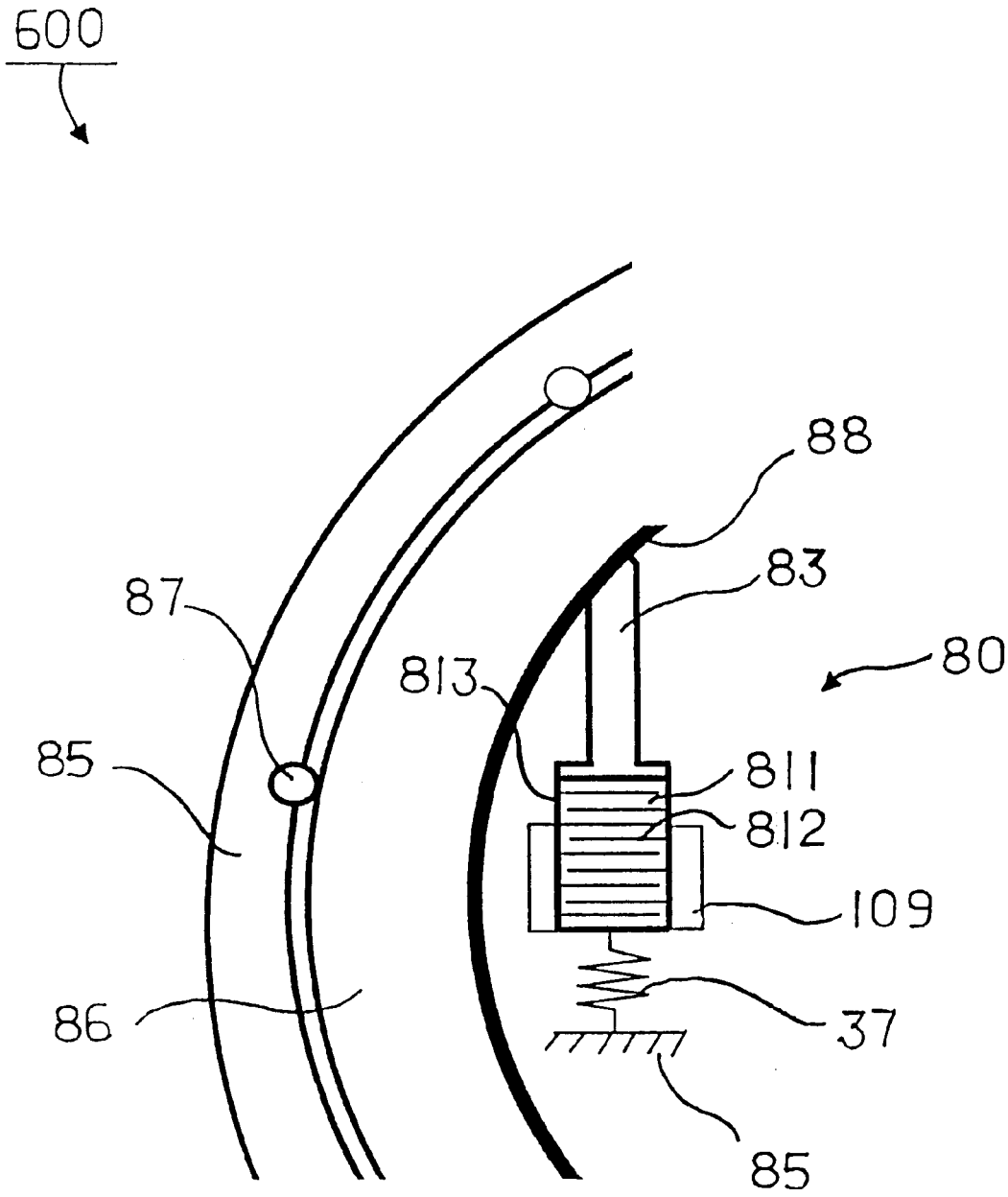
FIG. 14 is a top plan view showing a portion of an electronic watch according to Embodiment 6 of the invention.
Figure 15:
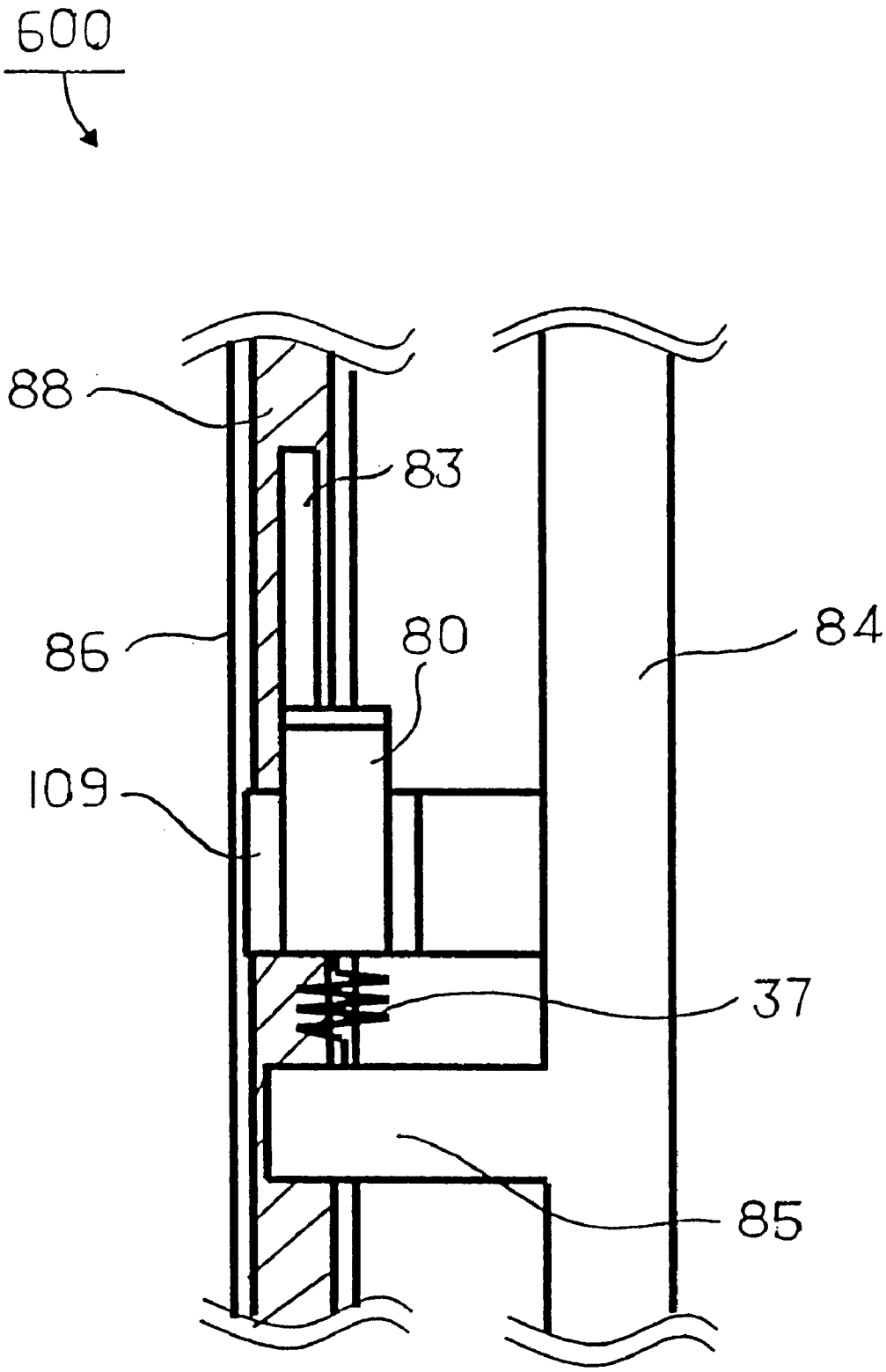
FIG. 15 is a sectional view of a portion of the electronic watch shown in FIG. 14.
Figure 16:
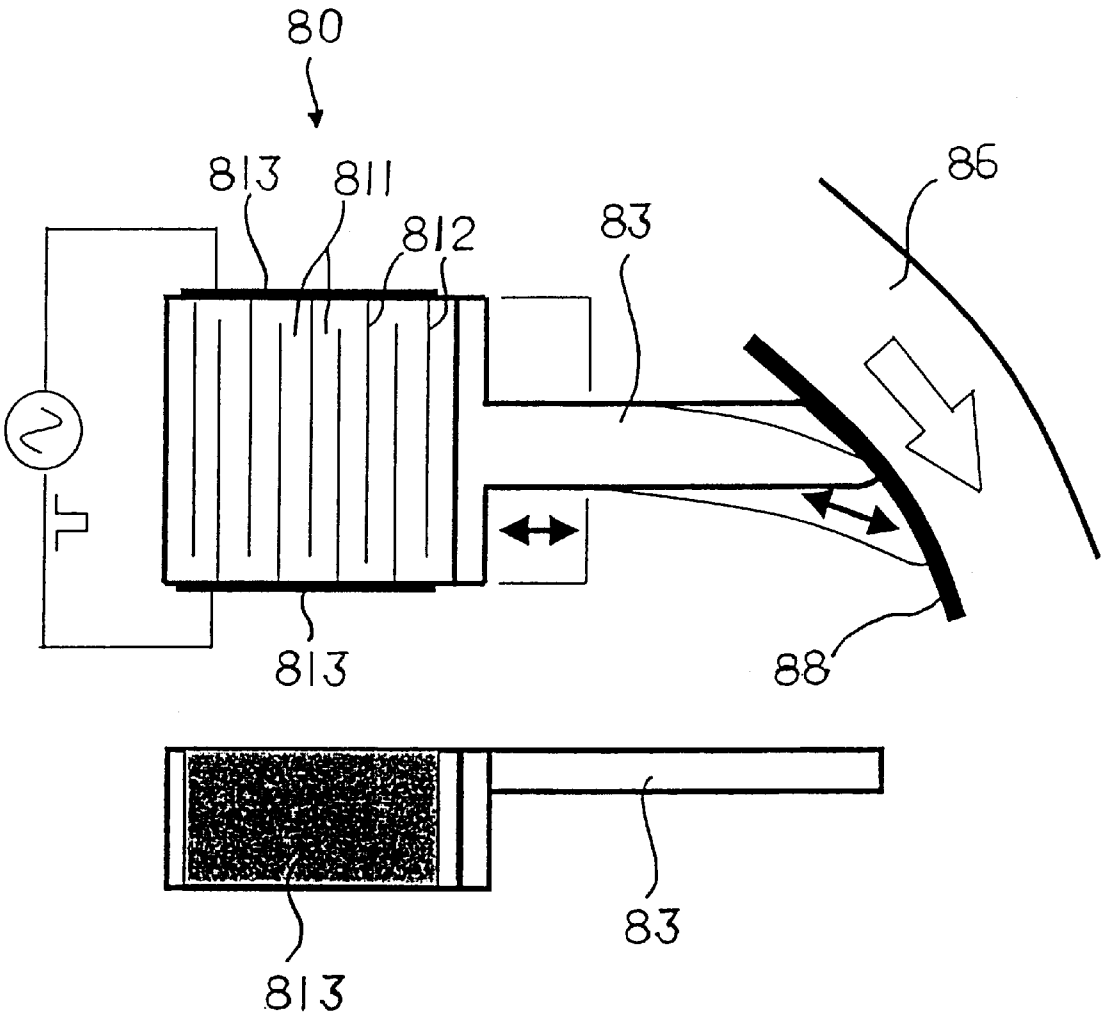
FIG. 16 is an explanatory view showing an operating principle by the piezoelectric actuator.
Figure 17:
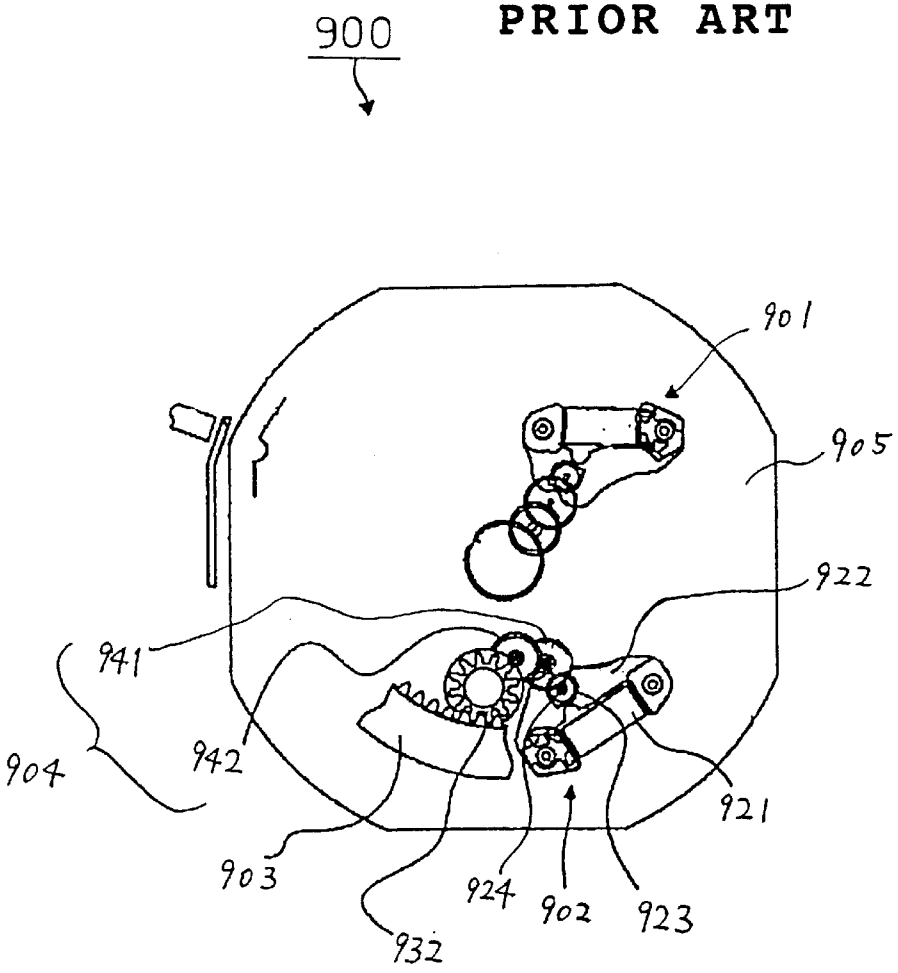
FIG.17 PRIOR ART
FIG. 17 is a top plan view showing one example of the electronic watch of the prior art.

FIG. 14 is a top plan view showing a portion of an electronic watch according to Embodiment 6 of the invention. FIG. 15 is a sectional view of a portion of the electronic watch shown in FIG. 14. FIG. 16 is an explanatory view showing an operating principle by the piezoelectric actuator. An electronic watch 600 according to Embodiment 6 is characterized by using a non-resonant type laminated piezoelectric actuator 80. This laminated piezoelectric actuator 80 is provided with a protrusion 83. In this electronic watch 600, the laminated piezoelectric actuator 80 is arranged in the vicinity of the inner circumference of a date ring 86 so that its protrusion 83 is brought into press contact with the date ring 86 by the pressure spring 37 thereby to drive the date ring directly by the frictional force. To the inner circumference of the date ring 83, there is adhered a sliding plate 88 for sliding on the protrusion 83. This sliding plate 88 is made of engineering plastics having a large friction coefficient and an excellent wear resistance. The laminated piezoelectric actuator 80 is supported by a support member 109 so that it can slide in the laminated direction of piezoelectric elements 811, and the pressure spring 37 is attached to a lug 85 which is formed on a base plate 84.

The piezoelectric elements 811 of the laminated piezoelectric actuator 80 are laminated by several tens to several hundreds, and electrodes 812 are sandwiched between the individual piezoelectric elements 811 so as to cover the generally whole area and are laminated and sintered.

The electrodes 812 are alternately grouped and are individually shorted by the external electrodes 813 so that the piezoelectric elements 811 of the number of laminations are connected parallel. The piezoelectric elements 811 thus laminated are connected in parallel. This laminated piezoelectric actuator 80 is manufactured by the green sheet laminating process. On the other hand, the protrusion 83 is obliquely cut at its leading end. The piezoelectric actuator 80 is arranged with its protrusion being in parallel with the tangential direction of the inner circumference of the date ring thereby to decide the angle of contact. The date ring 86 is held through a ball bearing 87 so as to rotate with respect to the base plate 84.

Here will be described the operations of the electronic watch 600. When a pulse voltage is applied to a piezoelectric element 81 of the laminated piezoelectric actuator 80, a large displacement can be established as a result of the lamination. Thus, the protrusion 83 is moved in the laminated direction of the piezoelectric elements so as to warp slightly in the moving direction of the date ring 86 because its leading end contacts with the sliding plate 88 of the date ring 86. As a result, the date ring 86 can be turned by the displacement of the protrusion 83. By applying the pulsating voltage to the piezoelectric elements 811, therefore, the protrusion 83 repeats elongations and contractions along the inner circumference of the date ring 86 so that the date ring 86 continuously rotates. According to this electronic watch 600, the calendar drive can be realized with the remarkably simple construction by the piezoelectric actuator of the small volume. Here in this construction, the base plate could be given the divided structure, as exemplified in Embodiment 3.

In the description thus far made, the second indication member has been exemplified by the date ring but should not be limited to the same. A calendar disc for indicating days, months and years, a moon face for indicating the age of the moon, and a chronograph gear, for example, could be driven by the aforementioned piezoelectric actuator.

According to the electronic watch of the invention, as has been described hereinbefore, the second indication member is is brought into press contact with the piezoelectric actuator so that it is directly driven. As a result, the electronic watch can be small-sized to enhance the degree of freedom for its design.

According to the electronic watch of the invention, on the other hand, the second indication member is disposed to confront the base plate, and the piezoelectric actuator is arranged between the base plate and the second indication member and is brought into press contact thereby to drive the second indication member directly. As a result, the planar space can be spared to reduce the electronic watch.

According to the electronic watch of the invention, on the other hand, the second indication member is disposed to confront the base plate and is provided with the beam portion on its face confronting the base plate, and the piezoelectric actuator is brought into press contact from the side face of the beam portion. As a result, the degree of freedom for designing the electronic watch can be enhanced to reduce the size and thickness of the electronic watch.

According to the electronic watch of the invention, on the other hand, the piezoelectric actuator is exemplified by the rectangular piezoelectric oscillator including: the first rectangular piezoelectric element provided on its surface with the four divided electrodes, the individual two of which are electrically shorted to construct two sets of electrode groups; and the second rectangular piezoelectric element having the electrode extending substantially all over the surface, the rectangular piezoelectric oscillator is caused to generate the bending oscillations and the longitudinal oscillations harmonically by applying the predetermined alternating voltage to the individual electrodes of the rectangular piezoelectric elements. As a result, the second indication member can be efficiently driven to reduce the size of the electronic watch.

According to the electronic watch of the invention, on the other hand, the piezoelectric actuator is exemplified by the rectangular piezoelectric oscillator including: the first rectangular piezoelectric element provided on its surface with the four electrodes, which are equally divided in the cross shape and electrically shorted in the orthogonal pairs to construct two sets of electrode groups; and the second rectangular piezoelectric element having the electrode extending substantially all over the surface, the rectangular piezoelectric oscillator is caused to generate the bending oscillations and the longitudinal oscillations harmonically by applying the predetermined alternating voltage to the individual electrodes of the rectangular piezoelectric elements. As a result, a higher force can be generated to reduce the size of the piezoelectric actuator itself thereby to reduce the size and thickness of a multi-function electronic watch effectively.

According to the electronic watch of the invention, on the other hand, the piezoelectric actuator is exemplified by the laminated piezoelectric oscillator which is prepared by laminating and sintering the rectangular piezoelectric elements. As a result, the force to be generated by the piezoelectric actuator can be increased according to the number of laminations. Thus, the higher output can be achieved in the smaller size so that the piezoelectric actuator itself can be drastically small-sized to reduce the size of the electronic watch.

According to the electronic watch of the invention, on the other hand, the piezoelectric actuator is provided on its surface with the protrusion, which is is brought into press contact with the second indication member to drive the same directly. As a result, it is possible to realize the drive of the second indication member stably in the high performance.

According to the electronic watch of the invention, on the other hand, the base plate is prepared by combining the first base plate and the second base plate having the fitting portion, and the piezoelectric actuator and the second indication member are mounted on the second base plate. As a result, the first base plate or the timing indication portion can be shared commonly among all the types of electronic watch so that many kinds of various electronic watches can be provided at reasonable prices.

According to the electronic watch of the invention, on the other hand, the electronic watch comprises the second indication member movement amount detecting means for detecting the amount of the movement of the second indication member, and the control circuit for controlling the piezoelectric actuator on the basis of the signal which is detected by the second indication member movement amount detecting means. The amount of the movement of the second indication member is detected so that the control circuit controls the driven state of the piezoelectric actuator on the basis of the amount of the movement detected.

According to the electronic watch of the invention, on the other hand, the electronic watch comprises the rotary member for engaging with the second indication member so that it may be interlocked by the same, and the second indication member movement amount detecting means detects the amount of the movement of the second indication member indirectly in terms of the rotating state of the rotary member. As a result, the angle of rotation of the rotary member can be accurately detected to detect the amount of the movement of the second indication member more accurately. Thus, the drive of an additional function can be accurately controlled to provide an electronic watch of a high performance.

What is claimed is:

1. An electronic timepiece comprising: a first indication member for indicating time; a driving mechanism for driving the first indication member to indicate the time; a second indication member for indicating information other than that indicated by the first indicating member; and a piezoelectric actuator arranged adjacent to the second indication member and having a piezoelectric element for undergoing vibration in response to application of an alternating voltage, the piezoelectric element having one side that is brought into direct contact with the second indication member while undergoing vibration in a given direction to cause the second indication member to undergo movement in the given direction.

2. An electronic timepiece according to claim 1; wherein the piezoelectric actuator is a rectangular piezoelectric oscillator comprising a first rectangular piezoelectric element having four divided electrodes on one surface, two of which are electrically shorted to each other to form two sets of electrode groups, and a second rectangular piezoelectric element having an electrode extending substantially over a surface thereof, so that the rectangular piezoelectric oscillator is caused to generate bending oscillations and longitudinal oscillations harmonically in response to application of an alternating voltage to the individual electrodes of the rectangular piezoelectric oscillator.

3. An electronic timepiece according to claim 2; wherein the piezoelectric actuator is a laminated structure comprising a piezoelectric oscillator formed of a plurality of laminated and sintered rectangular piezoelectric elements including the first rectangular piezoelectric element and the second rectangular piezoelectric element.

4. An electronic timepiece according to claim 1; wherein the piezoelectric actuator is a rectangular piezoelectric oscillator comprising a first rectangular piezoelectric element having four electrodes on one surface, the four electrodes being arranged in a cross shape and two orthogonal ones of the electrodes being electrically shorted to each other to form two sets of electrode groups, and a second rectangular piezoelectric element having an electrode extending substantially over a surface thereof, so that the rectangular piezoelectric oscillator is caused to generate bending oscillations and longitudinal oscillations harmonically in response to application of an alternating voltage to the individual electrodes of the rectangular piezoelectric oscillator.

5. An electronic timepiece according to claim 4; wherein the piezoelectric actuator is a laminated structure comprising a piezoelectric oscillator formed of a plurality of laminated and sintered rectangular piezoelectric elements including the first rectangular piezoelectric element and the second rectangular piezoelectric element.

6. An electronic timepiece according to claim 1; further comprising at least one protrusion formed on the one side of the piezoelectric actuator to be brought into contact with the second indication member to drive the second indication member in the given direction.

7. An electronic timepiece according to claim 1; further comprising a base plate underlying the first and second indication members and comprising a first base plate and a second base plate each having a fitting portion for being fitted to each other; wherein the piezoelectric actuator and the second indication member are mounted on the second base plate.

8. An electronic timepiece according to claim 1; further comprising second indication member movement detecting means for detecting the amount of movement of the second indication member in the given direction; and a control circuit for controlling the piezoelectric actuator on the basis of an output of the second indication member movement amount detecting means.

9. An electronic timepiece according to claim 8; further comprising a rotary member engaging with and interlocked by the second indication member; wherein the second indication member movement amount detecting means detects the amount of movement of the second indication member by detecting the rotating state of the rotary member.

10. An electronic timepiece according to claim 8; wherein the second indication member movement detecting means comprises a gear driven by the second indication member and having a hole formed therein, a slotted member having a slot through which the gear passes, the hole being formed in a portion of the gear that extends into the slot, a light emitting member disposed in the slot on one side of the gear, and a light detecting element disposed in the slot on an opposite side of the second indication member.

11. An electronic timepiece according to claim 1; wherein the first indication member comprises an analog time indicating hand, and the second indication member comprises a rotatably mounted disk-shaped member for indicating one of a calendar date and a moon phase.

12. An electronic timepiece according to claim 11; wherein the second indication member has a disk-shaped sleeve extending therefrom and being disposed adjacent the piezoelectric actuator so that the sleeve is driven by the piezoelectric actuator.

13. An electronic according to claim 11; wherein the second indication member has a groove formed in a peripheral outer surface thereof; and further comprising a base plate on which the piezoelectric actuator is mounted, the base plate having a flanged sleeve extending therefrom, a terminal end of the flange having a grooved formed therein and facing the groove formed in the second indication member; and a ball bearing disposed in the grooves.

14. An electronic timepiece according to claim 11; wherein the second indication member has a central sleeve extending therefrom, and the piezoelectric actuator is disposed adjacent the sleeve.

15. An electronic timepiece according to claim 1; wherein the second indication member is a calendar wheel having calendar dates from "1" through "31" imprinted thereon.

16. An electronic timepiece according to claim 1; further comprising a driving circuit for driving the piezoelectric actuator by applying a voltage to electrodes thereof in such a manner as to cause the one side thereof to undergo elliptical movement in the given direction.

17. An electronic timepiece according to claim 1; further comprising a wrist-mountable case in which the first and second indication members, and the piezoelectric actuator are disposed.

18. An electronic timepiece comprising: a first indication member for indicating time; a second indication member for indicating information other than that indicated by the first indication member; a base plate disposed to confront the second indication member; and a piezoelectric actuator arranged between the second indication member and the base plate and having a piezoelectric element for undergoing vibration in response to application of an alternating voltage, the piezoelectric element having one side that is brought into direct contact with the second indication member while undergoing vibration in a given direction to cause the second indication member to undergo movement in the given direction.

19. An electronic timepiece comprising: a first indication member for indicating time; a second indication member for indicating data other than that indicated by the first indication member; a base plate having a support member disposed on a face confronting the second indication member; and a piezoelectric actuator mounted on the support member and disposed adjacent to the second indication member and having a piezoelectric element for undergoing vibration in response to application of an alternating voltage, the piezoelectric element having one side that is brought into direct contact with the second indication member while undergoing vibration in a given direction to cause the second indication member to undergo movement in the given direction.

20. An electronic device for indicating information, comprising: a case; an indicator movably disposed in the case for indicating information having a changing value; and a rectangular piezoelectric actuator disposed in the case adjacent the indicator and having a piezoelectric element driven so that one end thereof undergoes movement in a given direction while in direct contact with the indicator to cause the indicator to undergo movement in the given direction to indicate the changing value of the information.

21. An electronic device according to claim 20; wherein the indicator has a disk shape and is rotatably mounted in the case, and the piezoelectric element is mounted so that the one end is disposed adjacent a circumferential surface of the indicator.

22. An electronic device according to claim 20; further comprising an indicator movement amount detector for detecting an amount of movement of the indicator; and a control circuit for controlling the piezoelectric actuator on the basis of an output of the indicator movement amount detector.

23. An electronic device according to claim 22; wherein the indicator movement amount detector comprises a gear driven by the indicator and having a hole formed therein, a slotted member having a slot through which the gear passes, the hole being formed in a portion of the gear that extends into the slot, a light emitting member disposed in the slot on one side of the gear, and a light detecting element disposed in the slot on an opposite side of the second indication member.

24. An electronic device according to claim 20; wherein the piezoelectric actuator comprises a first piezoelectric element having four divided electrodes on one surface, two of which are electrically shorted to each other to form two sets of electrode groups, and a second piezoelectric element having an electrode extending substantially over a surface thereof, so that the piezoelectric actuator is caused to generate bending oscillations and longitudinal oscillations harmonically in response to application of an alternating voltage to the individual electrodes of the first and second piezoelectric elements.

25. An electronic device according to claim 20; wherein the piezoelectric actuator comprises a first piezoelectric element having four electrodes on one surface, the four electrodes being arranged in a cross shape and two orthogonal ones of the electrodes being electrically shorted to each other to form two sets of electrode groups, and a second piezoelectric element having an electrode extending substantially over a surface thereof, so that the piezoelectric actuator is caused to generate bending oscillations and longitudinal oscillations harmonically in response to application of an alternating voltage to the individual electrodes of the first and second piezoelectric elements.

26. An electronic device according to claim 20; further comprising a spring for urging the piezoelectric element into contact with the indicator.

27. An electronic device according to claim 20; further comprising one or more protrusions formed on the one end of the piezoelectric actuator.

28. An electronic device according to claim 20; further comprising a biasing member for urging the piezoelectric element into contact with the indicator, the biasing member being disposed to confront the piezoelectric element with the indicator disposed between the piezoelectric element and the biasing member.

29. An electronic device according to claim 28; wherein the biasing member comprises a spring.

30. An electronic device according to claim 20; further comprising another indicator for indicating time.

* * * * *

UNITED STATES PATENT AND TRADEMARK OFFICE

CERTIFICATE OF CORRECTION

PATENT NO. : 6,515,941 B1
DATED : February 4, 2003
INVENTOR(S) : Kenji Suzuki et al.

It is certified that error appears in the above-identified patent and that said Letters Patent is hereby corrected as shown below:

Title page,
Item [30], insert:

-- Foreign Application Priority Data

March 2, 1999 [JP] Japan … 11-054600 --.

Signed and Sealed this

Thirteenth Day of April, 2004

JON W. DUDAS
*Acting Director of the United States Patent and Trademark Office*